US012059034B2

(12) United States Patent
Liu et al.

(10) Patent No.: US 12,059,034 B2
(45) Date of Patent: Aug. 13, 2024

(54) ELECTRONIC CIGARETTE ATOMIZATION CORE AND ATOMIZER

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 290 days.

(21) Appl. No.: 17/638,797

(22) PCT Filed: Aug. 14, 2020

(86) PCT No.: PCT/CN2020/109245
§ 371 (c)(1),
(2) Date: Feb. 25, 2022

(87) PCT Pub. No.: WO2021/036827
PCT Pub. Date: Mar. 4, 2021

(65) Prior Publication Data

US 2022/0273037 A1 Sep. 1, 2022

(30) Foreign Application Priority Data

Aug. 30, 2019 (CN) ..... 201910813562.0
Aug. 30, 2019 (CN) ..... 201921438935.2

(51) Int. Cl.
*A24F 40/46* (2020.01)
*A24F 40/42* (2020.01)
*A24F 40/44* (2020.01)

(52) U.S. Cl.
CPC ..... *A24F 40/46* (2020.01); *A24F 40/42* (2020.01); *A24F 40/44* (2020.01)

(58) Field of Classification Search
CPC ..... A24F 40/46; A24F 40/42; A24F 40/44; A24F 40/10; A24F 40/05
(Continued)

(56) References Cited

U.S. PATENT DOCUMENTS 10,357,064 B1 * 7/2019 Kleizo ..... H05B 3/44
11,019,688 B2 * 5/2021 Xiao ..... H05B 3/44
(Continued)

FOREIGN PATENT DOCUMENTS

CN 207885675 U 9/2018
CN 208425527 U 1/2019
(Continued)

OTHER PUBLICATIONS

International Search Report for International Application No. PCT/CN2020/109245 dated Oct. 28, 2020, 2 pages.

*Primary Examiner* — Alexander Gilman
(74) *Attorney, Agent, or Firm* — MASCHOFF BRENNAN; Michael Mauriel

(57) ABSTRACT

Disclosed are an electronic cigarette atomization core (4) and atomizer. The electronic cigarette atomization core (4) includes an ultrasonic atomization piece (46) disposed horizontally, a liquid guide cotton (45) disposed above the ultrasonic atomization piece (46), and an electrode plate (47) placed on the liquid guide cotton (45). Each end of the electrode plate (47) is provided with a curved segment (472). The curved segment (472) includes a first contact (4721)
(Continued)

located above a second contact (4722), wherein the first contact (4721) and the second contact (4722) are electrically connected but are distant horizontally, and the second contact (4722) abuts against an atomization surface electrode of the ultrasonic atomization piece (46) to form an electrical connection. A-middle part of the electrode plate (47) presses the liquid guide cotton (45) against the ultrasonic atomization piece (46) to form an atomization region, and the middle part of the electrode plate (47) is provided with a through hole (473) for exposing the atomization region. The electronic cigarette atomization core (4) and the atomizer ensure that the liquid guide cotton (45) well abuts against the atomization surface of the ultrasonic atomization piece (46) without any cotton pressing spring under the condition that an e-liquid atomization effect is not affected, and smoke generated by means of atomization and splashing c-liquid droplets are directly sprayed to an air outlet tube (3) without being shielded, thereby preventing a user from inhaling condensed e-liquid droplets and improving user experience.

18 Claims, 7 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2017/0136301 | A1* | 5/2017 | Cameron | A24F 40/65 |
| 2018/0161525 | A1* | 6/2018 | Liu | B05B 17/0661 |
| 2018/0325169 | A1* | 11/2018 | Guo | A24F 40/44 |
| 2018/0352854 | A1* | 12/2018 | Liu | A24F 40/05 |
| 2019/0116884 | A1* | 4/2019 | Conley | A61M 11/042 |
| 2019/0142063 | A1* | 5/2019 | Liu | A24F 40/485 131/329 |
| 2019/0159509 | A1* | 5/2019 | Cameron | A61M 15/0085 |
| 2019/0166905 | A1* | 6/2019 | Liu | A24F 40/05 |
| 2019/0183176 | A1* | 6/2019 | Liu | A24F 40/05 |
| 2019/0216135 | A1* | 7/2019 | Guo | A24F 40/44 |
| 2020/0107577 | A1* | 4/2020 | Liu | A24F 40/44 |
| 2022/0273037 | A1* | 9/2022 | Liu | A24F 40/44 |
| 2023/0165303 | A1* | 6/2023 | Liu | A24F 40/42 131/329 |

FOREIGN PATENT DOCUMENTS

| | | |
|---|---|---|
| CN | 208434721 U | 1/2019 |
| CN | 203633513 | 5/2019 |
| CN | 210782940 U | 6/2020 |

* cited by examiner

ELECTRONIC CIGARETTE ATOMIZATION CORE AND ATOMIZER

CROSS REFERENCE TO RELATED APPLICATIONS

This application is a U.S. National Phase application under 35 U.S.C. § 371 of International Application No. PCT/CN2020/109245 filed on Aug. 14, 2020, which claims priority to Chinese Application No. 201910813662.0 filed on Aug. 30, 2019 and claims priority to Chinese Application No. 201921438935.2 filed on Aug. 30, 2019.

FIELD OF THE INVENTION

The present invention relates to an electronic cigarette utensil, in particular to an electronic cigarette atomization core and atomizer.

BACKGROUND OF THE INVENTION

In an existing ultrasonic atomizer, a cotton pressing spring is disposed above an atomization region of liquid guide cotton. When smoke is sprayed out, the smoke needs to pass through the cotton pressing spring to reach an air outlet tube. Because the cotton pressing spring has a large number of turns, when the smoke passes through the cotton pressing spring, the surface of the cotton pressing spring is likely to accumulate or condense large e-liquid droplets. When the user smokes quickly, the e-liquid droplets condensed on the cotton pressing spring are easily inhaled into the user's mouth, which results in the feeling of inhaling e-liquid.

SUMMARY OF THE INVENTION

The technical problem to be solved by the present invention is to overcome the shortcomings of the prior art and provide an electronic cigarette atomization core and atomizer, in which an ultrasonic atomization piece is good in electrical contact without affecting the atomization effect and smoke is unlikely to condense.

In order to solve the above technical problems, the present invention provides an electronic cigarette atomization core, including an ultrasonic atomization piece disposed horizontally, liquid guide cotton being disposed above the ultrasonic atomization piece, wherein:

An electrode plate is placed on the liquid guide cotton;

Each end of the electrode plate is provided with a curved segment, the curved segment includes a first contact and a second contact, the first contact is located above the second contact, the first contact and the second contact are electrically connected but distant horizontally, and the second contact abuts against an atomization surface electrode of the ultrasonic atomization piece to form an electrical connection;

A middle part of the electrode plate presses a middle part of the liquid guide cotton against the ultrasonic atomization piece to form an atomization region, and the middle part of the electrode plate is provided with a through hole for exposing the atomization region.

In the present invention, the electrode plate is placed on the liquid guide cotton, the electrode plate is bent to symmetrically form curved segments each including a first contact and a second contact at two ends, the first contact is located above the second contact, the first and second contacts are electrically connected but distant horizontally, the first contact abuts against an inner end surface of an outer sleeve, and the second contact abuts against the atomization surface electrode of the ultrasonic atomization piece to form an electrical connection; when the first contact receives an extrusion force, the second contact is also extruded by a transmission force of the first contact, and the extrusion force received by the second contact enables the second contact and the atomization surface electrode of the ultrasonic atomization piece to form a more stable and elastic electrical connection; in addition, because the middle part of the electrode plate presses the liquid guide cotton against the ultrasonic atomization piece to form an atomization region, the liquid guide cotton abuts against the atomization surface of the ultrasonic atomization piece without any cotton pressing spring; when the second contact is extruded, the extrusion force is transmitted to the middle part of the electrode plate, so that the middle part of the electrode plate further stably presses the liquid guide cotton against the ultrasonic atomization piece; the middle part of the electrode plate is provided with a through hole for exposing the atomization region of the liquid guide cotton, the smoke generated by atomization is directly sprayed from the through hole to an air outlet tube, and the sprayed smoke is not shielded by any object, so the sprayed smoke is unlikely to condense and form e-liquid droplets, the user is prevented from inhaling the e-liquid droplets, and user experience is improved. Meanwhile, because the electrode plate only presses against the edge of the atomization region of the liquid guide cotton, the atomization effect of e-liquid will not be affected, the amount of smoke will not be reduced, and the user experience will not be affected.

Further, a second boss for pressing the liquid guide cotton is disposed in the through hole to better press the liquid guide cotton against the atomization surface of the ultrasonic atomization piece, so that the liquid guide cotton is in better contact with the ultrasonic atomization piece to improve the atomization efficiency.

Further, a rib for pressing the liquid guide cotton is disposed on the outer circumference or inside of the through hole to better press the liquid guide cotton against the atomization surface of the ultrasonic atomization piece, so that the liquid guide cotton is in better contact with the ultrasonic atomization piece to improve the atomization efficiency.

Further, the ultrasonic atomization piece is installed on an insulating seat, two ends of the electrode plate are provided with fixed segments, and the fixed segments are clamped on the outside of the insulating seat, so that the electrode plate is installed stably.

Further, the insulating seat is symmetrically provided with limiting grooves, and the electrode plate is clamped on the outside of the insulating seat via the limiting grooves to prevent the electrode plate from shaking to affect the effect that the ribs and the second bosses press the liquid guide cotton.

Further, an electrode assembly is disposed under the ultrasonic atomization piece, the electrode assembly has a first electrode end and a second electrode end, the fixed segments are bent toward the bottom surface of the insulating seat and directly electrically connected to the first electrode end of the electrode assembly, and a non-atomization surface electrode of the ultrasonic atomization piece abuts against the second electrode end, so that the electrode plate can not only conduct electricity but also can press the liquid guide cotton, and the electrode plate can be connected with the electrode assembly without welding, which facilitates the assembly and reduces the production cost. Further, the upper part of the outer sleeve is symmetrically provided with notches, both ends of the liquid guide cotton extend out of the outer sleeve via the notches to extend outward, and a first boss for clamped into the notches to fix an inner sleeve is disposed on the outer circumference of the inner sleeve. When the lower part of the inner sleeve is inserted into the outer sleeve, the first bosses are clamped into the notches, so that the inner sleeve cannot rotate relative to the outer sleeve, and the installation positions of air grooves on the inner sleeve are fixed.

Further, a fixing groove corresponding to the notches is disposed on the outer circumference of the outer sleeve, and a sealing sleeve for sealing the notches is sleeved in the fixing groove, to prevent smoke escape, so that all the smoke enters the air outlet tube for the user to inhale.

Further, a platform is disposed at bottom of the fixing groove, the sealing sleeve presses the liquid guide cotton extending out of the notches against the platform to prevent e-liquid from leaking into an atomization cavity, third bosses are symmetrically disposed on the inner wall of the sealing sleeve, and the third bosses are correspondingly engaged with the notches to prevent the sealing sleeve from rotating to affect the sealing effect.

Based on the same inventive concept, the present invention further provides art electronic cigarette atomizer, which includes a liquid cartridge and the electronic cigarette atomization core, two ends or one end of the liquid guide cotton are communicated with a liquid outlet of the liquid cartridge.

1—suction nozzle device; 11—suction nozzle; 12—air inlet;

2—liquid cartridge device; 21 liquid cartridge shell; 22—liquid cartridge; 23—liquid cartridge base;

221—liquid outlet;

3—air outlet tube;

4—atomization core; 41—atomization cavity; 42—outer sleeve; 43—inner sleeve; 44—electrode assembly; 45—liquid guide cotton; 46—ultrasonic atomization piece; 47—electrode plate; 48—insulating seat; 49—sealing sleeve; 421—notch; 422—fixing groove; 423—platform; 431—air groove; 432—first boss; 441—first electrode end; 442—second electrode end; 471—fixed segment; 472—curved segment; 4721—first contact; 4722—second contact; 473—through hole; 474—second boss; 475—rib; 481—limiting groove; 491—third boss; 5—fixed seat.

DETAILED DESCRIPTION OF THE EMBODIMENTS

The present invention will be further described below with reference to specific preferred embodiments, but the scope of protection of the present invention is not limited thereby.

For ease of description, the relative positional relationships of components, such as upper, lower, left, and right, are described according to the layout direction of the accompanying drawings in the specification, and do not limit the structure of this patent.

Embodiment 1

Figure 1:
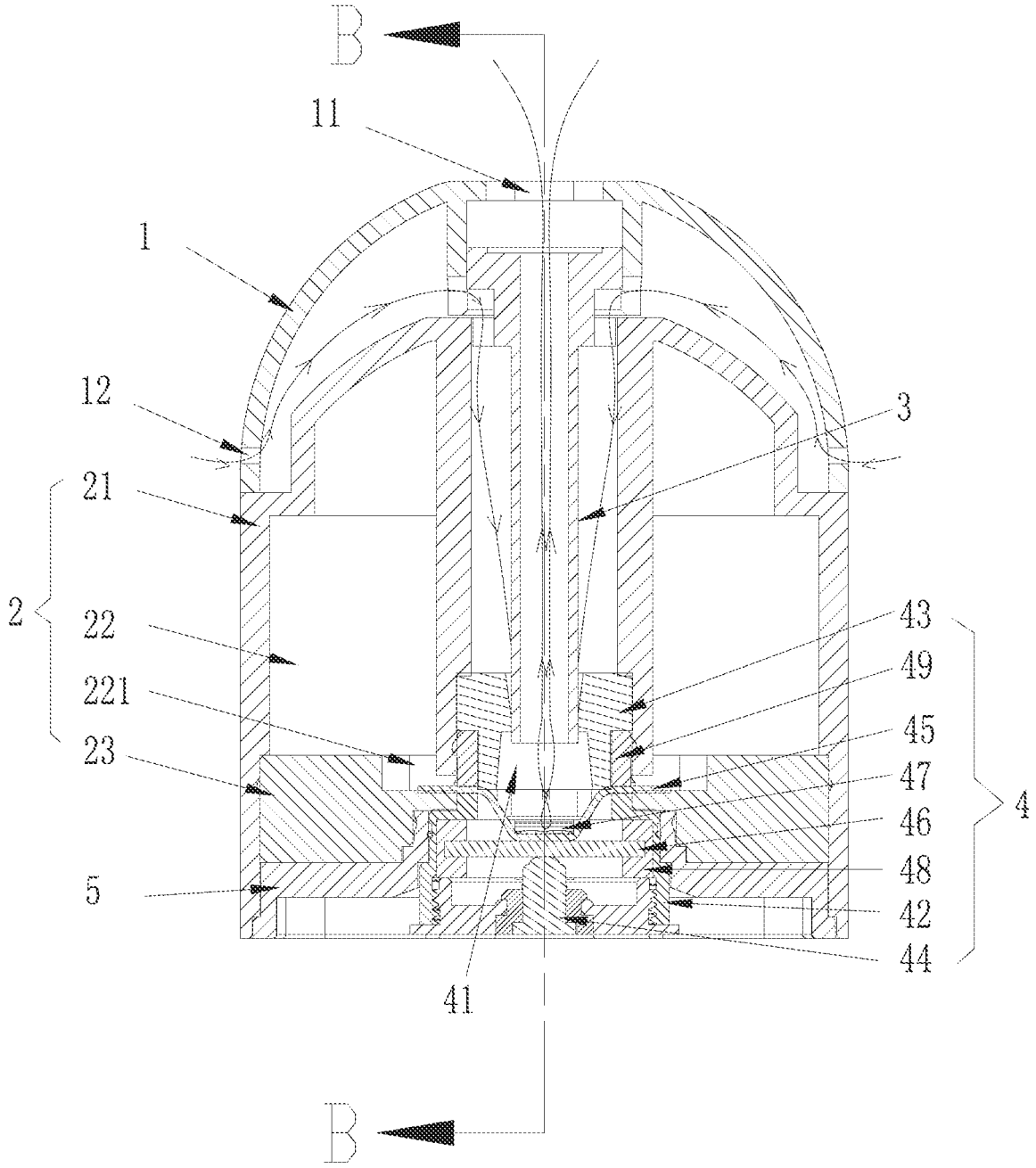
FIG. 1 is a schematic structural diagram of an embodiment of an atomizer of the present invention (arrows in the figure indicate the direction of air flow).
Figure 2:
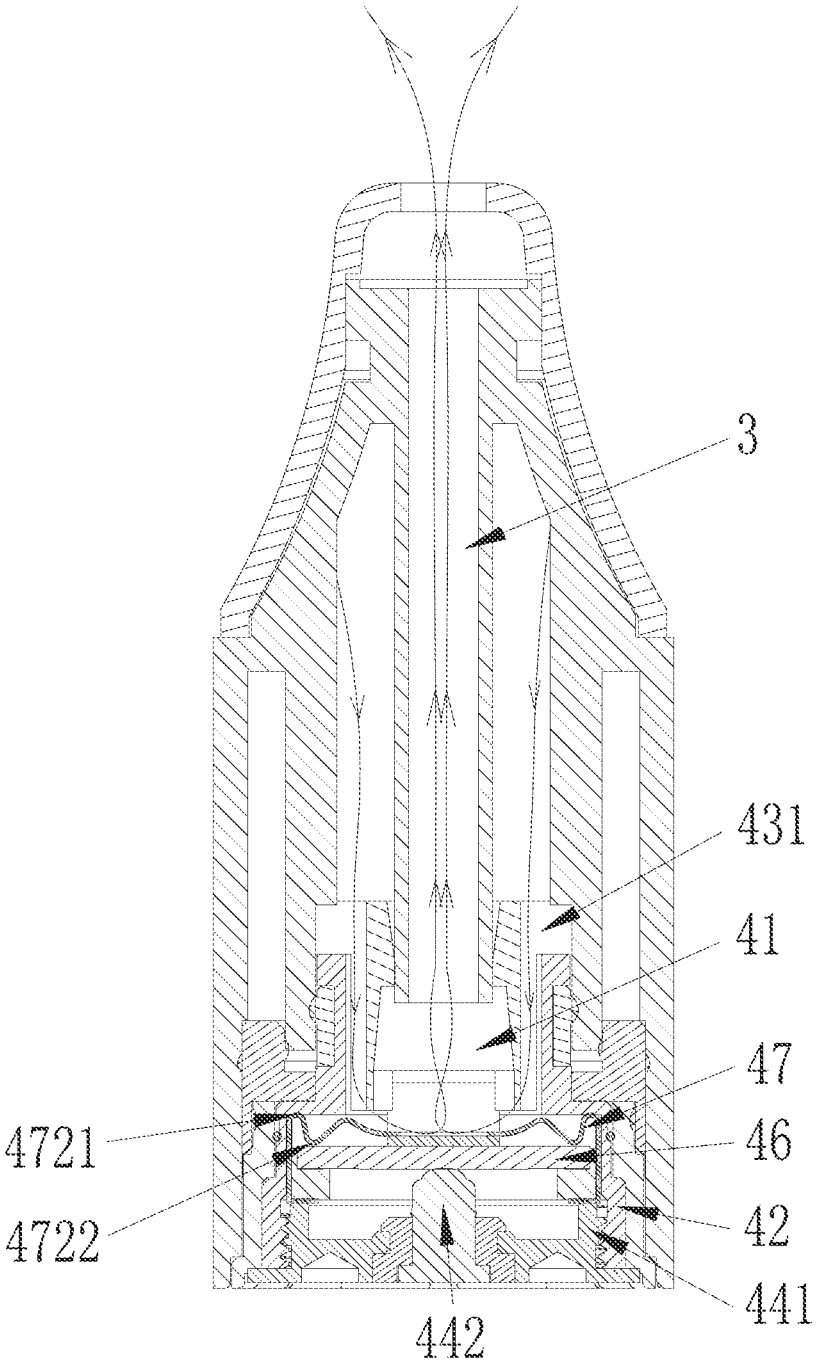
FIG. 2 is a cross-sectional view taken along line B-B in FIG. 1 (arrows in the figure indicate the direction of air flow).
Figure 3:
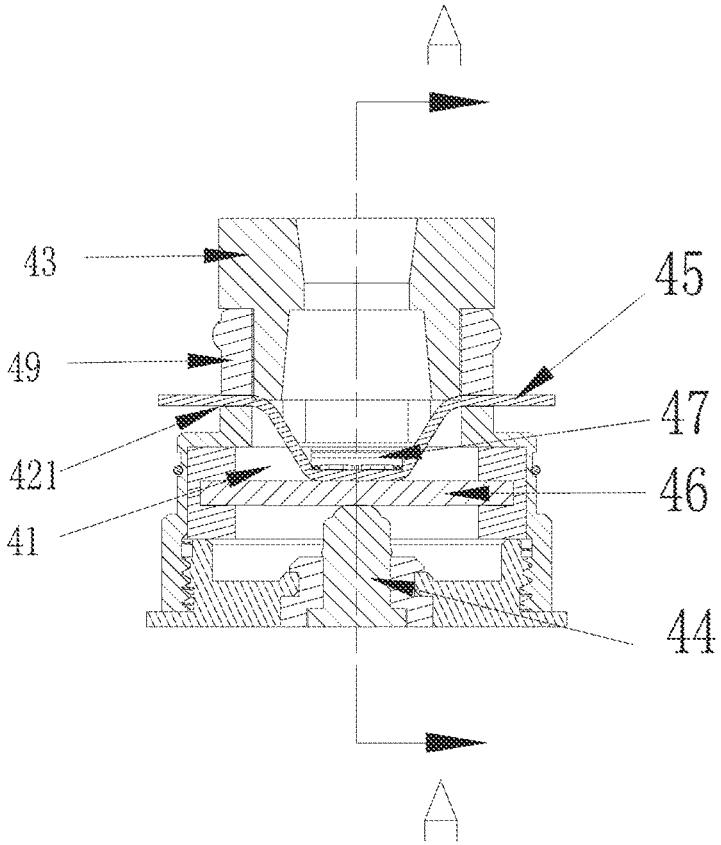
FIG. 3 is a schematic structural diagram of an embodiment of an atomization core of the present invention.
Figure 4:
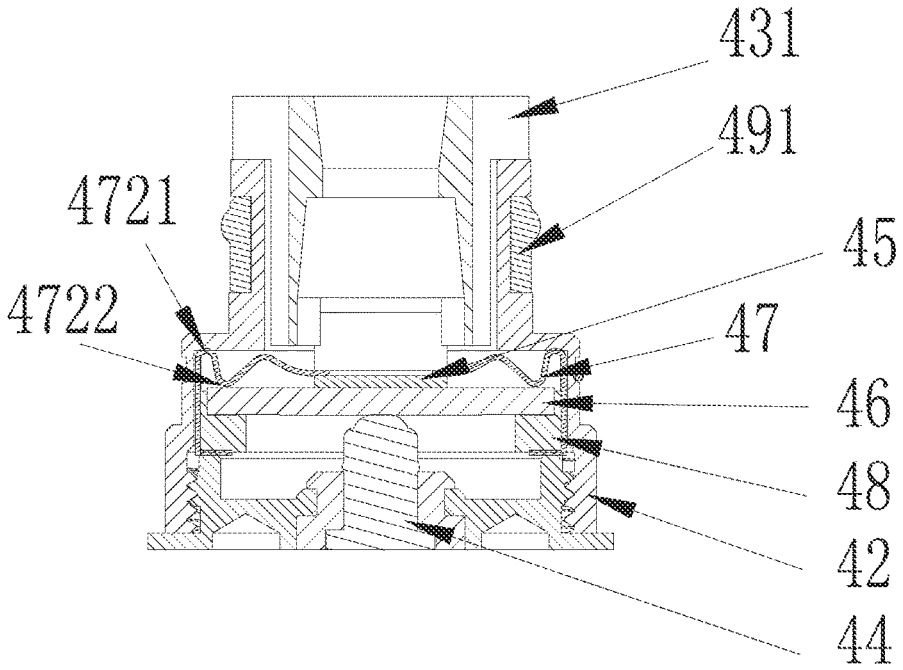
FIG. 4 is a cross-sectional view taken along line A-A in FIG. 3.
Figure 5:
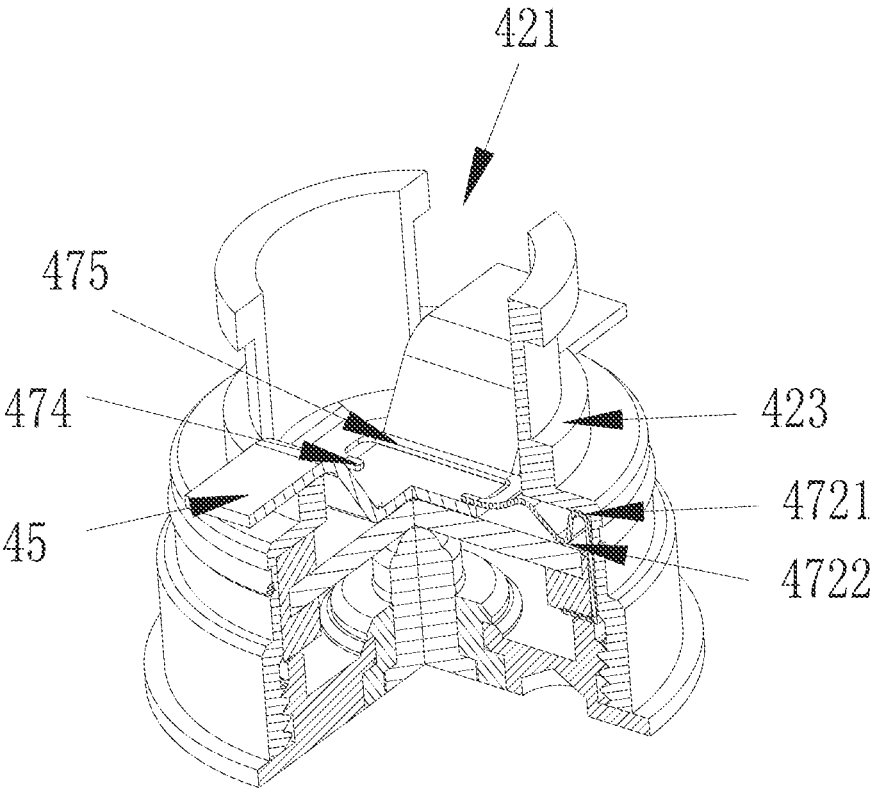
FIG. 5 is a partial cross-sectional three-dimensional structural diagram of the atomization core without an inner sleeve according to the present invention.
Figure 6:
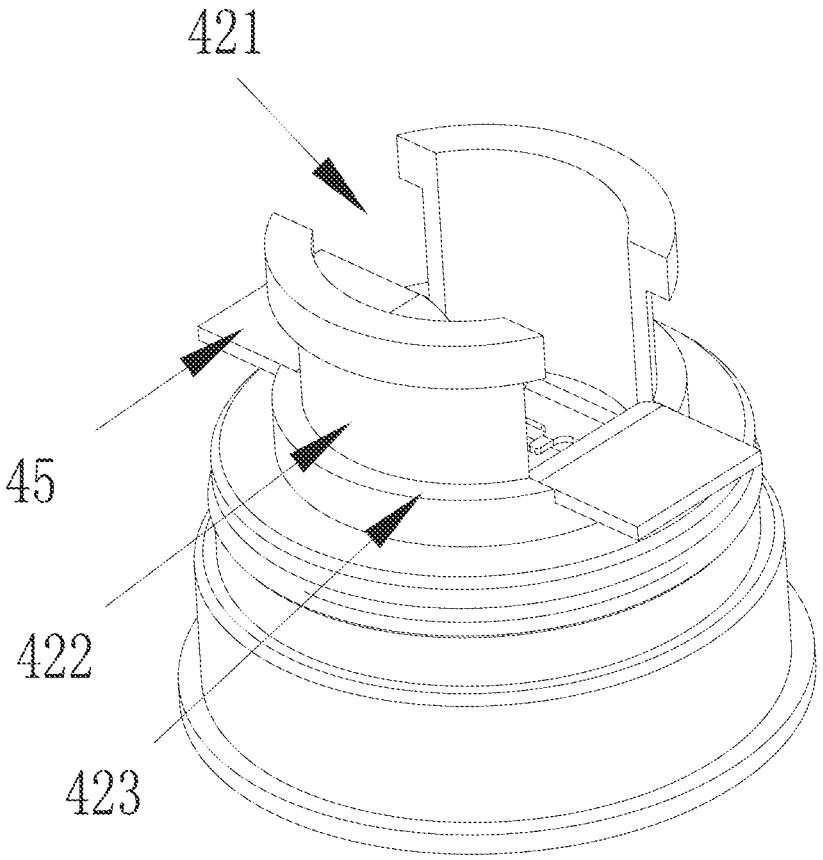
FIG. 6 is a three-dimensional structural diagram of the atomization core without the inner sleeve according to the present invention.
Figure 7:
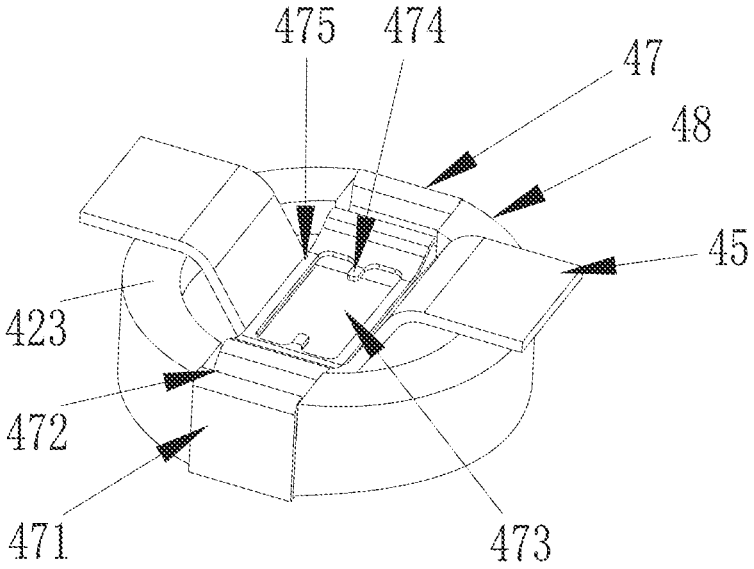
FIG. 7 is an assembly structure diagram of an outer sleeve, liquid guide cotton and an electrode plate according to the present invention.
Figure 8:
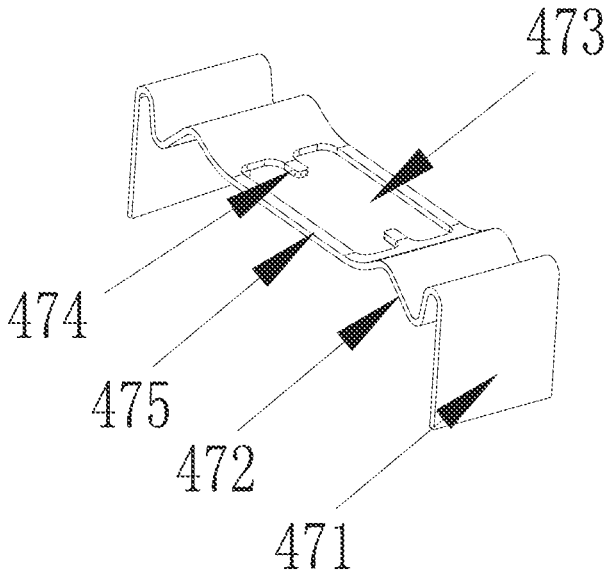
FIG. 8 is a three-dimensional structure diagram of the electrode plate of the present invention.
Figure 9:
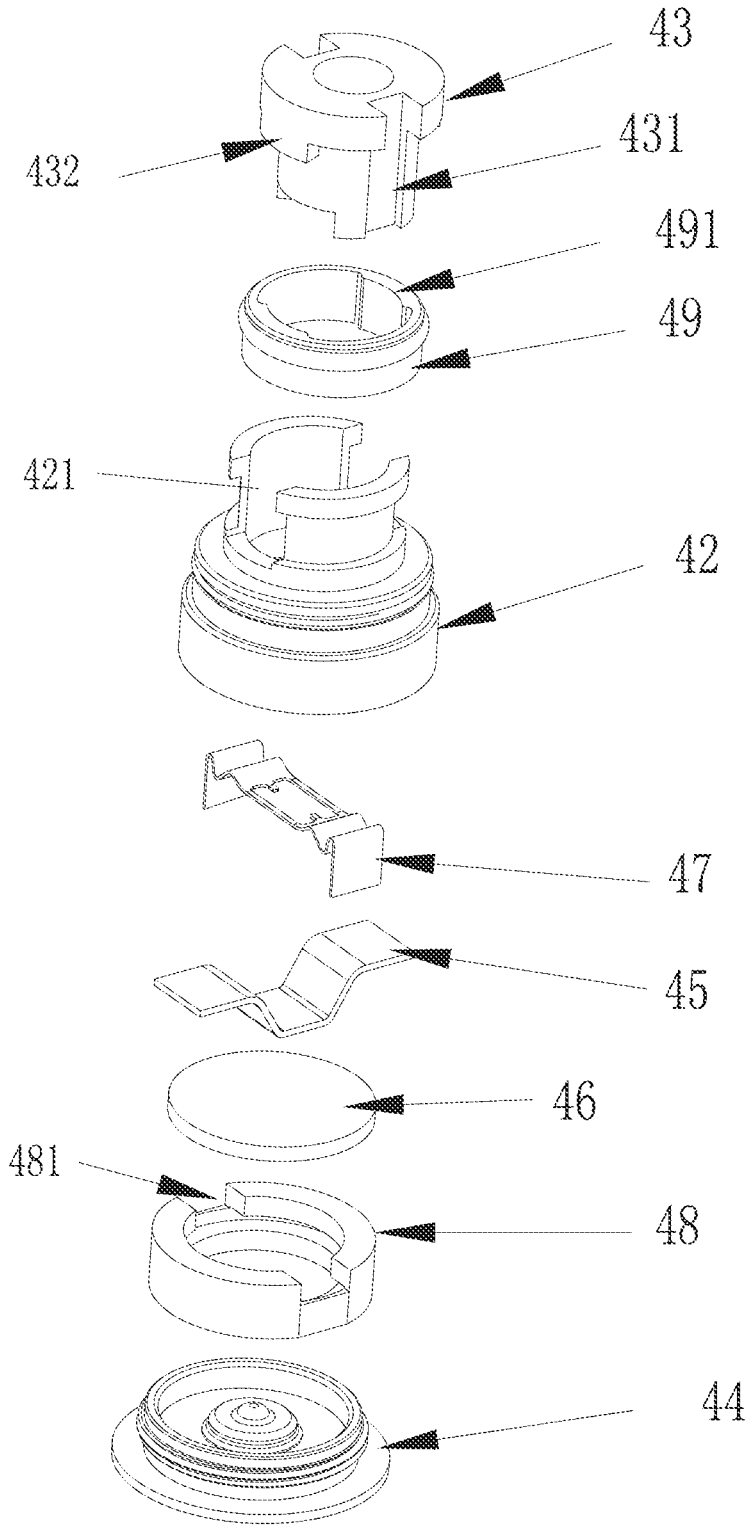
FIG. 9 is an exploded view of components of the atomization core of the present invention.

As shown in FIGS. 1 to 9, an embodiment of an electronic cigarette atomizer according to the present invention includes a suction nozzle device 1 and a liquid cartridge device 2 connected to each other, the suction nozzle device 1 is provided with a suction nozzle 11 and an air inlet 12, an air outlet tube 3 and an atomization core 4 are disposed in the middle of the liquid cartridge device 2, an atomization cavity 41 is formed in the atomization core 4, the top of the air outlet tube 3 is communicated with the suction nozzle 11, and the bottom of the air outlet tube 3 extends into the atomization cavity 41, such that the atomization cavity 41, an inner cavity of the air outlet tube 3, anti the suction nozzle 11 are communicated with each other to form a smoke discharge channel, and the air inlet 12, the outer circumference of the air outlet tube 3, and the atomization cavity 41 are communicated with each other to form an outside air inlet channel.

The liquid cartridge device 2 includes a liquid cartridge shell 21 and a liquid cartridge base 23 combined with each other. After the liquid cartridge shell 21 and the liquid cartridge base 23 are combined, a liquid cartridge 22 is formed therein. The bottom of the liquid cartridge 22 is provided with a liquid outlet 221.

The atomization core 4 includes an outer sleeve 42. An inner sleeve 43, an electrode plate 47, liquid guide cotton 45, an ultrasonic atomization piece 46, and an electrode assembly 44 are sequentially disposed in an inner cavity of the outer sleeve 42 from top to bottom. An atomization cavity 41 is formed between the bottom of the inner sleeve 43 and the ultrasonic atomization piece 46. An atomization surface electrode is disposed on the upper surface of the ultrasonic atomization piece 46, and a non-atomization surface electrode is disposed on the lower surface. When the atomization surface electrode of the ultrasonic atomization piece 46 is electrically conducted with the non-atomization surface electrode, the ultrasonic atomization piece 46 ultrasonically oscillates. In this embodiment, the atomization surface electrode of the ultrasonic atomization piece 46 is electrically connected to a first electrode end 441 of the electrode assembly 44 by the electrode plate 47, and the non-atomization surface electrode of the ultrasonic atomization piece 46 is electrically connected to a second electrode end 442 of the electrode assembly 44.

The upper part of the outer sleeve 42 is symmetrically provided with notches 421 that facilitate the extension of two ends of the liquid guide cotton 45, a fixing groove 422 surrounds the outer circumference of the upper part of the outer sleeve 42, and a platform 423 is disposed at the bottom of the fixing groove 422.

Air grooves 431 and first bosses 432 are symmetrically disposed on the outer circumference of the inner sleeve 43, and the air grooves 431 and the first bosses 432 are staggered. One ends of the air grooves 431 are communicated with the air inlet 12, and the other ends are communicated with the atomization cavity 41. The first bosses 432 are disposed toward the notches 421, and the width of the first bosses 432 matches that of the notches 421. When the lower pa of the inner sleeve 43 is inserted into the outer sleeve 42, the first bosses 432 are clamped into the notches 421, so that the inner sleeve 43 cannot rotate relative to the outer sleeve 42, even if the positions of the air grooves 431 on the inner sleeve 43 are fixed.

The two ends of the liquid guide cotton 45 pass through the notches 421 of the outer sleeve 42 and extend outward through the platform 423 to be below the liquid outlet 221, and the middle part of the liquid guide cotton 45 is placed on an atomization surface of the ultrasonic atomization piece 46.

The ultrasonic atomization piece 46 is installed on an insulating seat 48, the top of the insulating seat 48 is symmetrically provided with limiting grooves 481, and the limiting grooves 481 are staggered with the notches 421.

A fixed segment 471 and a curved segment 472 are sequentially disposed from both ends of the electrode plate 47 to the middle part, the electrode plate 47 straddles the liquid guide cotton 45, and the fixed segment 471 of the electrode plate 47 straddles the limiting grooves 481 and is clamped on the outside of the insulating seat 48, so that the electrode plate 47 can be used to conduct electricity and press the liquid guide cotton 45. Further, the fixed segment 471 is bent toward the bottom of the insulating seat 48, so that the electrode plate 47 is fixed better; and the electrode plate 47 is directly electrically connected to the first electrode end 441 of the electrode assembly 44 through the bent portion without welding, so that the assembly is simple and convenient. The curved segment 472 includes a first contact 4721 and a second contact 4722, the first contact 4721 is located above the second contact 4722, and the first and second contacts 4721 and 4722 are electrically connected but distant horizontally. The first contact 4721 abuts against an inner end surface of the outer sleeve 42, and the second contact 4722 abuts against the atomization surface of the ultrasonic atomization piece 46 to form an electrical connection. When the first contact 4721 is extruded, the second contact 4722 is also deformed and extruded, so that the circuit connection between the second contact 4722 and the ultrasonic atomization piece 46 is more stable. The middle part of the electrode plate 47 is recessed to abut the liquid guide cotton 45 against the ultrasonic atomization piece 46, and the middle part of the electrode plate 47 is provided with a through hole 473 for exposing the middle part of the liquid guide cotton 45, so that smoke can be directly sprayed out from the through hole 473 without being shielded, and is unlikely to condense. Two ends of the through hole 473 are provided with second bosses 474 extending into the through hole 473, ribs 475 are disposed on both sides of the through hole 473, and both the second bosses 474 and the ribs 475 abut against the liquid guide cotton 45. When the curved segment 472 is curved and deformed, the ribs 475 will produce pressure on the liquid guide cotton 45, so that the liquid guide cotton 45 will not be separated from the atomization surface of the ultrasonic atomization piece 46.

A sealing sleeve 49 is disposed in the fixing groove 422 of the outer sleeve 42 to seal the notches 421 to prevent smoke escape, and to press the liquid guide cotton 45 against the platform 423 to prevent e-liquid from leaking into the atomization cavity 41. Third bosses 491 are symmetrically disposed on the inner wall of the sealing sleeve 49, and the third bosses 491 are correspondingly engaged with the notches 421 to prevent the sealing sleeve 49 from rotating to affect the sealing effect.

The forgoing descriptions are only preferred embodiments of the present application, and do not limit the present application in any form although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The invention claimed is:

1. An electronic cigarette atomization core, comprising an ultrasonic atomization piece (46) disposed horizontally, liquid guide cotton (45) being disposed above the ultrasonic atomization piece, wherein an electrode plate (47) is placed on the liquid guide cotton;

each end of the electrode plate is provided with a curved segment (472), the curved segment comprises a first contact (4721) and a second contact (4722), the first contact is located above the second contact, the first contact and the second contact are electrically connected but distant horizontally, and the second contact abuts against an atomization surface electrode of the ultrasonic atomization piece to form an electrical connection;

a middle part of the electrode plate presses a middle part of the liquid guide cotton against the ultrasonic atomization piece to form an atomization region, and the middle part of the electrode plate is provided with a through hole (473) for exposing the atomization region.

2. The electronic cigarette atomization core according to claim 1, wherein a second boss (474) for pressing the liquid guide cotton is disposed in the through hole.

3. An electronic cigarette atomizer, comprising a liquid cartridge (22) and the electronic cigarette atomization core according to claim 2, wherein two ends or one end of the liquid guide cotton are communicated with a liquid outlet of the liquid cartridge.

4. The electronic cigarette atomization core according to claim 1, wherein a rib (475) for pressing the liquid guide cotton is disposed on an outer circumference or inside of the through hole.

5. An electronic cigarette atomizer, comprising a liquid cartridge (22) and the electronic cigarette atomization core according to claim 4, wherein two ends or one end of the liquid guide cotton are communicated with a liquid outlet of the liquid cartridge.

6. The electronic cigarette atomization core according to claim 1, wherein the ultrasonic atomization piece is installed on an insulating seat (48), two ends of the electrode plate are provided with fixed segments (471), and the fixed segments are clamped on the outside of the insulating seat.

7. An electronic cigarette atomizer, comprising a liquid cartridge (22) and the electronic cigarette atomization core according to claim 1, wherein two ends or one end of the liquid guide cotton are communicated with a liquid outlet of the liquid cartridge.

8. An electronic cigarette atomizer, comprising a liquid cartridge (22) and the electronic cigarette atomization core according to claim 6, wherein two ends or one end of the liquid guide cotton are communicated with a liquid outlet of the liquid cartridge.

9. The electronic cigarette atomization core according to claim 6, wherein the insulating seat is symmetrically provided with limiting grooves (481), and the electrode plate is clamped on the outside of the insulating seat via the limiting grooves.

10. An electronic cigarette atomizer, comprising a liquid cartridge (22) and the electronic cigarette atomization core according to claim 9, wherein two ends or one end of the liquid guide cotton are communicated with a liquid outlet of the liquid cartridge.

11. The electronic cigarette atomization core according to claim 6, wherein an electrode assembly (44) is disposed under the ultrasonic atomization piece, the electrode assembly has a first electrode end and a second electrode end, the fixed segments are bent toward the bottom surface of the insulating seat and directly electrically connected to the first electrode end of the electrode assembly, and a non-atomization surface electrode of the ultrasonic atomization piece abuts against the second electrode end.

12. An electronic cigarette atomizer, comprising a liquid cartridge (22) and the electronic cigarette atomization core according to claim 11, wherein two ends or one end of the liquid guide cotton are communicated with a liquid outlet of the liquid cartridge.

13. The electronic cigarette atomization core according to claim 1, further comprising an outer sleeve (42) and an inner sleeve (43) sheathed with each other, wherein the ultrasonic atomization piece is disposed in the outer sleeve, the first contact abuts against the bottom surface of the outer sleeve, the upper part of the outer sleeve is symmetrically provided with notches (421), both ends of the liquid guide cotton extend out of the outer sleeve via the notches to extend outward, and a first boss (432) is clamped into the notches to fix the inner sleeve and disposed on an outer circumference of the inner sleeve.

14. An electronic cigarette atomizer, comprising a liquid cartridge (22) and the electronic cigarette atomization core according to claim 13, wherein two ends or one end of the liquid guide cotton are communicated with a liquid outlet of the liquid cartridge.

15. The electronic cigarette atomization core according to claim 13, wherein a fixing groove (422) corresponding to the notches is disposed on an outer circumference of the outer sleeve, and a sealing sleeve (49) for sealing the notches is sleeved in the fixing groove.

16. An electronic cigarette atomizer, comprising a liquid cartridge (22) and the electronic cigarette atomization core according to claim 15, wherein two ends or one end of the liquid guide cotton are communicated with a liquid outlet of the liquid cartridge.

17. The electronic cigarette atomization core according to claim 15, wherein a platform (423) is disposed at bottom of the fixing groove, the sealing sleeve presses the liquid guide cotton extending out of the notches against the platform, third bosses (491) are symmetrically disposed on the inner wall of the sealing sleeve, and the third bosses are correspondingly engaged with the notches.

18. An electronic cigarette atomizer, comprising a liquid cartridge (22) and the electronic cigarette atomization core according to claim 17, wherein two ends or one end of the liquid guide cotton are communicated with a liquid outlet of the liquid cartridge.

* * * * *